United States Patent [19]

Brame

[11] Patent Number: 4,856,149

[45] Date of Patent: Aug. 15, 1989

[54] TAPE LEASH

[76] Inventor: William D. Brame, P.O. Box 107, Bellflower, Calif. 90706

[21] Appl. No.: 168,159

[22] Filed: Mar. 15, 1988

[51] Int. Cl.[4] ..... A44B 21/00

[52] U.S. Cl. ..... 24/3 A; 24/16 R; 24/442

[58] Field of Search ..... 24/3 A, 16 R, 335, 336, 24/343, 23 B, 265 C, 442, 17 B, 17 AP

[56] References Cited

U.S. PATENT DOCUMENTS

| | | | |
|---|---|---|---|
| 1,164,928 | 12/1915 | Corcoran | 24/3 A |
| 2,970,729 | 2/1961 | Allen | 24/30.5 P |
| 3,372,438 | 3/1968 | Rinecker | 24/16 R |
| 3,383,738 | 5/1968 | Fox et al. | 24/306 |
| 3,947,927 | 4/1976 | Rosenthal | 24/16 R |
| 3,994,048 | 11/1976 | Rosenthal | 24/16 R |
| 4,473,524 | 9/1984 | Paradis | 24/16 PB |

FOREIGN PATENT DOCUMENTS

| | | | |
|---|---|---|---|
| 1331650 | 9/1973 | United Kingdom | 24/442 |

OTHER PUBLICATIONS

New Tape Tote Tape Dispensing System Prive List; one sheet.

New Tape Tote Tape Dispensing System, Copyright 1987 Tape Mate; one sheet.

*Primary Examiner*—Victor N. Sakran

*Attorney, Agent, or Firm*—Charles H. Thomas

[57] ABSTRACT

A tape leash is provided to facilitate the application of masking tape, duct tape and other types of tape where large quantities of tape are to be applied. The tape leash is comprised of strap elements which may be releasably linked in pairs to form two separate loops. The strap elements in one pair are releasably secured about the wrist of a user and the free ends of the strap elements of the other pair are passed through the center opening of a roll of tape and releasably secured to each other. The roll of tape is thus linked to the wrist of the user to greatly facilitate and expedite the manual application of tape drawn from the roll.

10 Claims, 1 Drawing Sheet

TAPE LEASH

BACKGROUND OF THE INVENTION

1. Field of the Invention

The present invention relates to a tape leash used for expediting and facilitating the manual application of tape drawn from a roll of tape.

2. Description of the Prior Art

There are many commercial and industrial operations in which large quantities of tape must be applied either as a preparation for a subsequent operation or as a fabrication step in the performance of some procedure. For example, in the automotive vehicle repainting industry it is necessary to apply large quantities of masking tape to a vehicle as a preparation for painting the vehicle. Numerous rolls of masking tape are employed to cover the trim, door handles, bumpers, windshields and headlights of an automotive vehicle to protect those portions of the vehicle from paint which is subsequently sprayed onto the body of the vehicle.

The application of masking tape in the automotive repainting industry is very labor intensive and requires a considerable amount of time. Due to the extensive amount of manual labor which is necessary to apply masking tape to an automotive vehicle prior to painting, the preparatory step of masking represents a substantial portion of the expense of repainting a vehicle.

Masking tape, and numerous other types of tape, are manufactured in rolls which have an annular configuration. Typically, the tape is wound in a spiral about a central annular cardboard or paperboard spool. To manually apply the tape to some structure, such as an automotive vehicle, for example, the user grasps the spool of tape with one hand and anchors the exposed end of the tape with the other hand while pulling the spool away from the anchored end of the tape. As the spool is pulled it turns in rotation, allowing tape to be fed off of the spool and manually positioned as desired.

In the application of masking tape to an automotive vehicle prior to painting the vehicle, it is often difficult to accurately position the tape on the trim or other portion of the vehicle to be covered while the tape is being drawn off of the spool. When the tape is inaccurately positioned, it is necessary for the person applying the tape to stop drawing tape off of the spool and to utilize both hands to adjust the position of the tape which has already been dispensed. To perform such an adjustment, the person applying the tape must tear off the strip of tape which has been dispensed and set the remainder of the roll of tape down so as to free both hands in order to perform the necessary repositioning of the tape that has been dispensed. Since lengths of tape must be repositioned with considerable frequency, the user is constantly setting down and picking up spools of tape.

The repeated laying aside and retrieval of rolls of tape adds considerably to the time required to complete the job of masking an automotive vehicle prior to painting the vehicle. Moreover, in applying masking tape to an automotive vehicle it is frequently necessary for an individual to move about the vehicle in order to effectuate proper adjustment of the position of the tape. Consequently, the user frequently is required to walk several steps in order to retrieve a roll of tape previously set aside. Furthermore, the roll of tape is often misplaced when it is set aside and some time is expended in visually locating the roll of tape in order to retrieve it.

Various tape dispensing systems have been devised to attempt to solve the foregoing problems, but no satisfactory system has yet been achieved. According to one conventional system a fabric strap is employed with a Velcro contact surface at its center and mating Velcro contact surfaces at its opposite ends. The fabric strap is passed through the center opening of the spool of a roll of tape and the ends of the fabric strap are passed through adjacent belt loops in the trousers of the wearer. The end extremities of the fabric strap are folded back over the belt loops and the mating Velcro contact surfaces are secured together so that the roll of tape is carried on the fabric strap between adjacent belt loops on the wearer's trousers.

This prior tape dispensing system does hold the unused portion of the roll of tape close to the body of the individual applying the tape from the roll. However, it involves considerable disadvantages. Since the roll of tape is held against the belt of the user, the user can draw a maximum length of tape from the roll approximately equal to the length of the user's arm. A strip of tape equal to that length must be torn off each time the user draws tape from the roll. This is because the user cannot reach down to pull off more tape with the hand used to draw tape from the roll without fouling the length of tape which has already been extracted from the roll. The time required to repeatedly tear off lengths of tape approximately thirty to thirty six inches in length significantly increases the overall time required to apply the masking tape.

SUMMARY OF THE INVENTION

The present invention is a device which is extremely useful for facilitating the manual application of tape from a roll of tape. In one broad aspect the invention may be considered to be a leash formed of a first pair of strap sections releasably securable together to form a first loop for encircling the wrist of a user. The leash also includes a second pair of strap sections which likewise are releasably securable together to form a second loop for capturing a roll of tape. The first and second pairs of strap sections are permanently secured to each other. The free ends of the strap sections within each pair may be releasably coupled to each other to form a loop. Alternatively, they may be separated from each other in order to encircle the wrist of the user or capture a roll of tape.

In use, one of the loops of the tape leash of the invention encircles the wrist of the wearer and the other loop carries the roll of tape. During the application of tape the roll of tape is held loosely in the hand of the user and turns within the user's hand as the tape is pulled off of the roll. The user is able to exert exacting control over the tape alignment to the area being covered as the user is able to normally guide the tape from the roll using the index finger of the hand in which the roll is held.

When repositioning of the tape that has been fed off of the roll is necessary, the user merely releases the roll of tape from the hand in which it is grasped, thereby freeing both hands so that misaligned tape can be repositioned. When the roll of tape is released, it remains suspended from the user's wrist by means of the leash of the invention. To retrieve the roll of tape, the user merely flexes the fingers of the hand toward the roll of tape suspended from the wrist of that hand, so that the roll of tape is promptly retrieved. The user then resumes drawing out the tape from the roll in the manner previously described.

One of the loops of the tape leash of the invention is comprised of a first pair of strap elements each having one free end. The strap elements in the first pair are permanently secured together remote from the free ends. The free ends of the first pair of strap elements are adapted for mutually releasable engagement with each other to thereby form a first loop. The tape leash of the invention also employs a second pair of strap elements which likewise each have a free end. The strap elements in the second pair are also permanently secured to each other and to the strap elements in the first pair remote from their free ends. The free ends of the second pair of strap elements are adapted for mutually releasable engagement from each other to thereby form a second loop. At least one of the loops is adapted to encircle a wrist of a user and at least another of the loops is adapted to capture the roll of tape to thereby link the roll of tape to the wrist of the user.

While the free ends of the strap elements may be releasably secured together by any number of different coupling mechanisms, preferably a first one of the strap elements in each pair of strap elements has a contact surface on its free end bearing a multiplicity of minute flexible hooks projecting therefrom. The second one of the strap elements in each pair has a contact surface on its free end bearing a looped fabric pile. The contact surfaces on the strap elements in each pair of strap elements are positionable in juxtaposed face to face relation, whereupon the hooks become releasably engaged in the looped pile to form the loops of the tape leash. Suitable mating strips having contact surfaces of this type are sold under the registered trademark Velcro.

While the tape leash of the invention has particular utility in the automotive vehicle repainting industry, it is extremely useful in numerous other diverse taping applications as well. For example, the tape leash of the invention may be employed in masking sinks, counters and other interior furnishings as a preparatory step to painting the interior of a room. Likewise, the tape leash of the invention may be used to apply masking tape prior to exterior building painting as well. It is also quite useful in taping drywall in the construction industry. The tape leash of the invention may be employed in virtually all automotive, marine, commercial, industrial and household taping operations, and is particulary useful in trades in which the application of large quantities of tape is necessary.

One very significant advantage which the tape leash of the invention has compared with conventional tape dispensing systems is the proximity with which the tape is held to the hand of the user. Since the roll of tape is linked to the wrist of the user, the roll of tape is suspended from the user's wrist when the user requires freedom of movement of the fingers of both hands. However, the roll of tape is maintained in such close proximity to the user's hand that it can be retrieved with a mere flick of the wrist. Also, the manner in which tape is drawn off of a roll of tape greatly facilitates the accurate application of the tape. Because the tape roll is suspended from one of the user's wrists, tension exerted on the exposed end of the tape will naturally draw the tape roll up into the palm of the user's hand to which the tape roll is linked. Because the roll of tape is captured by one of the loops immediately adjacent to the user's hand, the user is able to more accurately guide the tape off of the roll using the index finger of the hand to which the roll of tape is releasably secured. The degree of control thus exerted in dispensing tape from the roll significantly reduces the extent to which tape drawn from the roll must be repositioned to properly mask a structure in preparation for painting.

The invention may be described with greater clarity and particularity by reference to the accompanying drawings.

DESCRIPTION OF THE EMBODIMENT

Figure 1:
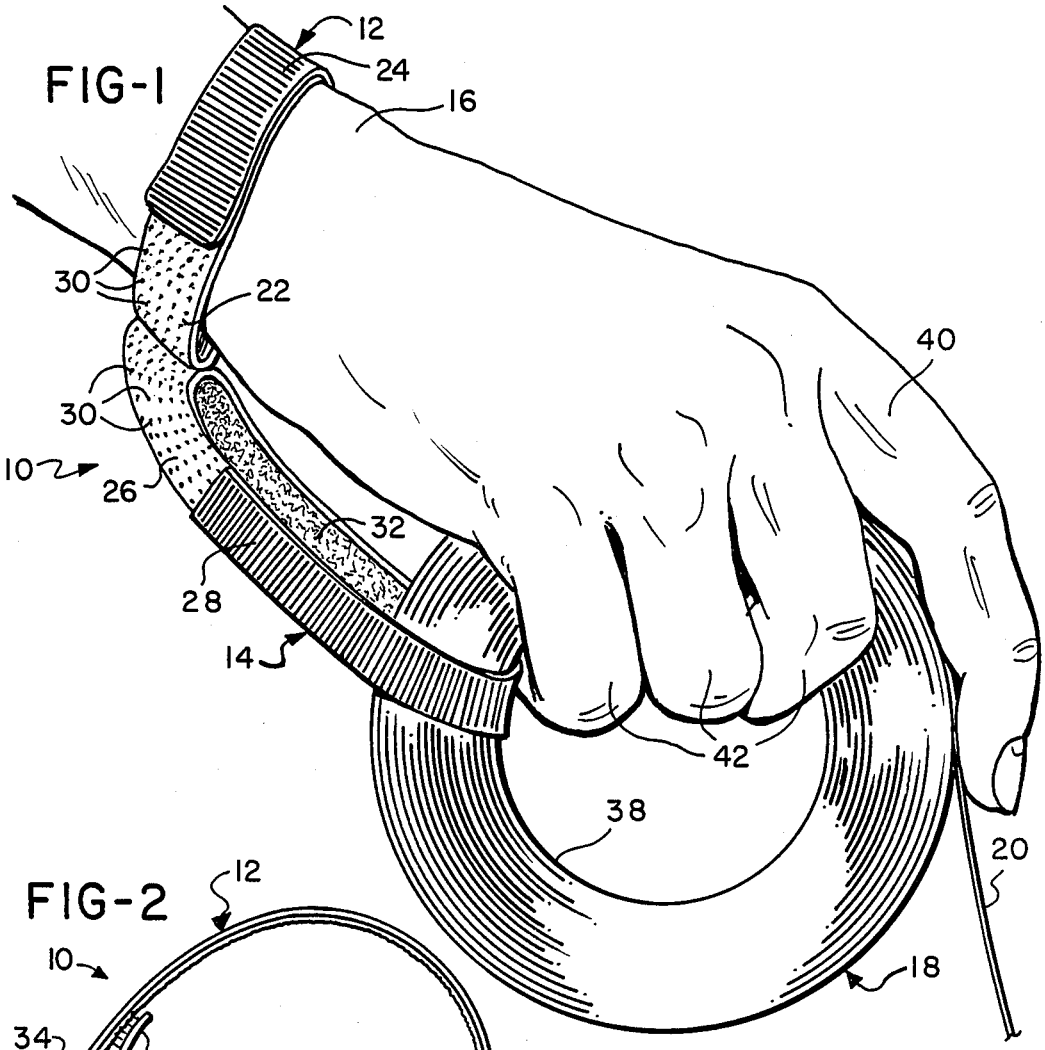
FIG. 1 is a side elevational view illustrating the manner of use of a tape leash according to the invention.
Figure 2:
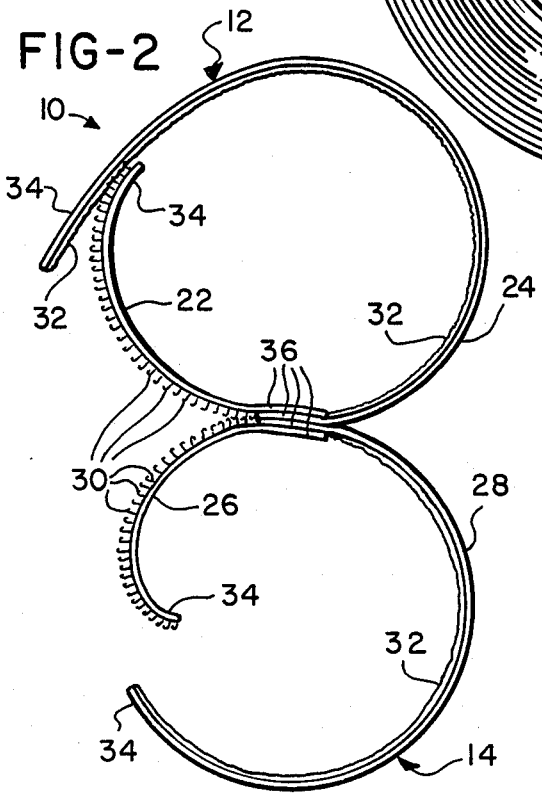
FIG. 2 is a front elevational view of the tape leash of FIG. 1.
Figure 3:
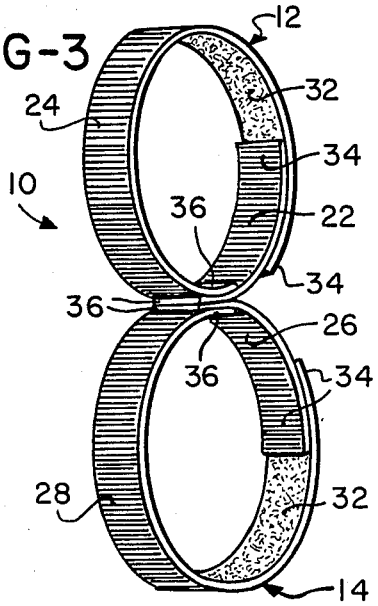
FIG. 3 a perspective view of the tape leash of FIG. 1.

FIGS. 2 and 3 illustrate a tape leash 10 according to the invention which is a device adapted to facilitate the manual application of tape from a roll of tape. The tape leash 10 is comprised of a pair of flexible links or loops 12 and 14 permanently secured to each other. Both of the links 12 and 14 are capable of being opened and the link 14 is illustrated in the open condition in FIG. 2. When opened, at least one of the links 12 and 14 may be passed about a user's wrist 16 to encircle it in the manner depicted in FIG. 1. When opened, the ends of at least the other of the links 12 and 14 may be passed through a roll 18 of tape 20. Both of the links 12 and 14 are capable of being releasably closed so as to secure the roll 18 of tape 20 to the wrist 16 of a user, as depicted in FIG. 1.

Each of the links or loops 12 and 14 is comprised of first and second releasable straps of fabric material, preferably a durable thermoplastic material such as nylon. That is, the link or loop 12 employs a first strap 22 which is preferably between about one and two inches in width and about four inches in length. The second strap 24 of the link 12 is of equal width and is about seven and one half inches in length. The first strap 26 of the loop or link 14 is preferably about three quarters of an inch in width and about four inches in length, while the second strap 28 of the link 14 is of equal width and about seven and one half inches in length. The straps 26 and 28 of the loop or link 14 in particular must be constructed of heavy duty, abrasion resistant material.

The first straps 22 and 26 are formed as strips of the hook portion of a fabric hook and loop fastener. That is, the strap sections 22 and 26 are each formed with a multiplicity of outwardly projecting minute flexible hooks 30. The second strap sections 24 and 28 on the other hand, are formed of strips of looped fabric pile of a mating material. Each of the strap sections 24 and 28 has a contact pad 32 which bears a multiplicity of flexible nylon loops. The facing contact surfaces of the straps in each of the loops 12 and 14 are positionable in juxtaposition facing each other, whereby the hooks 3 are releasably engageable in the pile of the contact pad 32.

Each of the straps 22, 24, 26 and 28 has a free end 34 and an anchoring end 36. The contact surfaces of the free ends 34 and 36 of the first and second straps in each pair are positionable with a selectively variable amount of longitudinal overlap, to thereby selectively vary the sizes of the loops or links 12 and 14. That is, the free ends 34 of the straps 22 and 24 can be overlapped longitudinally a substantial distance to tighten the loop of the link 12 into a small circumference to accommodate a small wrist 16. Alternatively, the free ends 34 of the straps 22 and 24 may be overlapped only a relatively short distance, whereupon the circumference of the loop 12 is expanded to accommodate a large wrist 16. Likewise, the free ends 34 of the straps 26 and 28 can be longitudinally overlapped to either a greater or lesser extent to vary the circumference of the loop or link 14.

As best illustrated in FIGS. 2 and 3, the anchoring ends 36 of the straps in each pair of straps overlap for a distance of about one half inch and are ultrasonically welded at their anchoring ends 36. That is, the anchoring ends of the straps 22 and 24 are welded to each other and the anchoring ends 36 of the straps 26 and 28 are welded to each other to respectively form the loops 12 and 14. The loops or links 12 and 14 may be oriented in a generally coplanar relationship, as illustrated, or attached together at any desired angle suitable for the tape dispensing operation to be performed. In the manufacturing process, the two nylon straps 24 and 28 are preferably permanently secured at their mutually juxtaposed anchoring ends 36 by ultrasonic welding to secure the loops 12 and 14 to each other. That is, heat is applied to the anchoring ends 36 of the straps 24 and 28 so that their anchoring ends 36 are fused together.

To utilize the tape leash 10 the free end 34 of the strap 24 of the loop or link 12 is peeled away from the free end 34 of the mating strap section 22. When the free ends 34 of the straps 22 and 24 are separated in this fashion, they can be passed about either side of the wrist 16 of the user. The inwardly facing looped pile 32 on the free end 34 of the strap 24 is then pressed inwardly against the outwardly facing surface of the free end 34 of the strap 22 so that the hooks 30 become releasably enmeshed in the pile 32. Similarly, the free ends 34 of the strap sections 26 and 28 of the loop or link 14 are pulled apart from each other in the manner depicted in FIG. 2. The strap 28 of the link 14 is then passed through the central opening 38 in the spool of the tape roll 18 and the free end 34 of the strap section 28 is then pressed against the free end 34 of the strap 26, thereby again closing the loop of the link 14 to capture the tape roll 18 in the manner depicted in FIG. 1.

The user draws the tape 20 from the tape roll 18 by pulling longitudinally on the exposed end of the tape 20 so that the tape 20 is pulled off of the tape roll 18. Preferably, the user employs the index finger 40 to guide the tape 20 into a proper position as it leaves the roll 18 while loosely holding the tape roll 18 with the thumb and fingers 42.

When tape that has been pulled from the roll is to be repositioned, the user merely releases the roll 18 from the fingers 42. The roll of tape 18 will remain suspended, joined to the user's wrist 16 by the connecting links 14 and 12. Once the user has performed the necessary readjustment of the positioning of the tape 20, the tape roll 18 is seized again by merely drawing on the exposed end of the tape 20. The tension thus exerted pulls the tape roll 18 up into the palm of the user's hand whereupon the user inserts the fingers 42 into the central opening 38 and continues to pull tape 20 from the roll 18 in the manner described.

The links 12 and 14 may be opened and closed repeatedly to allow fresh rolls of tape to be inserted and to allow the user to remove the tape leash 10 from the wrist 16. The Velcro material of which the tape leash 10 is constructed is of a highly durable quality and will withstand repeated separations and reengagements.

Undoubtedly, numerous variations and modifications of the invention will become readily apparent to those familiar with commercial, industrial and household operations that require quantities of tape to be dispensed. For example, other types of releasable fasteners, such as hooks or snaps, could be employed in place of the fabric fastening strips depicted and described. Also, the loops of the tape leash of the invention can be constructed of elastic material, if desired. Accordingly, the scope of the invention should not be construed as limited to the specific embodiments depicted and described, but rather is defined in the claims appended hereto.

I claim:

1. A device for use in manually applying tape from a roll of tape comprising a leash formed of a first pair of strap sections both having free ends which bear contact sensitive mating releasable fastening means, and said free ends are releasably securable to each other to form a first loop with said free ends of said first pair of strap sections disposed to extend in directions opposite to each other and in juxtaposed overlapping relationship for encircling the wrist of a user and a second pair of strap sections both having free ends which bear contact sensitive mating releasable fastening means, and said free ends of said second pair of strap sections are releasably securable to each other to form a second loop with said free ends of said second pair of strap sections disposed to extend in directions opposite to each other and in juxtaposed overlapping relationship for capturing said roll of tape, and said first and second pairs of strap sections are permanently secured to each other.

2. A device according to claim 1 wherein all of said strap sections are comprised of flexible fabric material and a free end of one of said straps sections in each of said pair of strap sections has a contact surface bearing a multiplicity of outwardly projecting flexible hooks and said free end of the other of said strap sections in each of said pairs of strap sections has a contact surface bearing a flexible looped pile, and said contact surface within each pair of strap sections are positionable in juxtaposition against each other, whereby said hooks are releasably engageable in said pile.

3. A device according to claim 2 wherein said contact surfaces of said strap sections in each pair are positionable with a selectively variable extent of longitudinal overlap, to thereby selectively vary the circumferences of said loops.

4. A device according to claim 1 wherein each of said strap sections is comprised of two separate links of flexible fabric each having one of said free ends and an anchoring end, and the anchoring ends of said separate fabric links within each pair of strap sections are permanently secured together.

5. A device adapted to facilitate manually drawing tape from a roll of tape comprising a pair of flexible links permanently secured to each other wherein each of said links is comprised of a pair of strap sections which have releasably securable free ends that extend in opposite directions and are positionable in face to face overlapping contact with each other to releasably close the perimeters of said links wherein said free ends of said strap sections of both of said links are capable of being opened so that at least one of said links is releasably securable about a wrist of the user at least the other of said links is releasably securable through said roll of tape, and the free ends of said strap sections of both of said links are capable of being releasably closed to secure said roll of tape to said wrist of said user.

6. A device according to claim 5 wherein each of said links is comprised of first and second flexible straps and said first straps have contact surfaces formed with a multiplicity of minute flexible hooks and said second straps have contact surfaces with a looped fabric pile thereon, and the contact surfaces of the straps within each of said links are positionable in face to face overlapping contact with each other to releasably close the perimeters of said links.

7. A device according to claim 6 wherein said straps are fashioned of nylon and all of said straps have free ends and anchored ends and said anchored ends of said straps within each pair are secured together by thermal welding.

8. A device for facilitating the manual dispensation of tape from a roll of tape comprising a first pair of strap elements each having a free end and which are permanently secured together remote from said free ends, wherein said free ends of said first pair of strap elements are adapted for mutually releasable engagement extending in opposite directions and in face to face overlapping relationship with each other to thereby form a first loop, and a second pair of strap elements each having a free end and which are permanently secured to each other and to said strap elements in said first pair remote from said free ends, and wherein the free ends of said second pair of strap elements are adapted for mutually releasable engagement extending in opposite directions and in face to face overlapping relationship with each other to thereby form a second loop, whereby at least one of said loops is adapted to encircle the wrist of a user and at least another of said loops is adapted to capture said roll of tape to thereby link said roll of tape to said wrist of said user.

9. A device according to claim 8 wherein a first one of said strap elements in each pair has a contact surface on its free end bearing a multiplicity of minute, flexible hooks projecting therefrom and a second one of said strap elements in each pair has a contact surface on its free end bearing a looped fabric pile, and said contact surfaces on said strap elements in each pair are positionable in juxtaposed face to face relation, whereupon said hooks become releasably engaged in said looped pile to form said loops.

10. A device according to claim 9 wherein said strap elements are constructed of a thermoplastic material and are secured to each other by welding.

* * * * *